United States Patent [19]

Suzuki

[11] 4,300,501

[45] Nov. 17, 1981

[54] APPARATUS FOR CONTROLLING THE ROTATIONAL SPEED OF AN I.C. ENGINE IN AN IDLING OPERATION

[75] Inventor: Suzuo Suzuki, Yokosuka, Japan

[73] Assignee: Nissan Motor Company, Limited, Yokohama, Japan

[21] Appl. No.: 968,723

[22] Filed: Dec. 12, 1978

[30] Foreign Application Priority Data

Dec. 28, 1977 [JP] Japan ..... 52-159578

[51] Int. Cl.[3] ..... F02M 3/06

[52] U.S. Cl. ..... 123/339; 123/352; 123/360; 123/585

[58] Field of Search ..... 123/102, 119 EC, 97 R, 123/103 R, 124 B

[56] References Cited

U.S. PATENT DOCUMENTS

| | | | |
|---|---|---|---|
| 3,103,128 | 9/1963 | Gordon | 123/102 |
| 3,304,068 | 2/1967 | Thomas | 123/103 R X |
| 3,455,260 | 7/1969 | Mennesson | 123/102 X |
| 3,964,457 | 6/1976 | Coscia | 123/124 B X |
| 4,008,696 | 2/1977 | Hisatomi | 123/97 B |
| 4,091,777 | 5/1978 | Monpetit et al. | 123/102 X |
| 4,108,127 | 8/1978 | Chapin et al. | 123/124 R |
| 4,138,975 | 2/1979 | Hamelin et al. | 123/102 |
| 4,181,104 | 1/1980 | Shinoda | 123/102 |

FOREIGN PATENT DOCUMENTS

| | | | |
|---|---|---|---|
| 2036864 | 7/1980 | United Kingdom | 123/585 |

*Primary Examiner*—Tony M. Argenbright

*Attorney, Agent, or Firm*—Lowe, King, Price & Becker

[57] ABSTRACT

Apparatus for controlling the rotational speed of an I.C. engine in an idling operation comprises a constant pressure valve, a solenoid valve, and a control signal generator. A constant vacuum pressure produced by the constant pressure valve is modified by atmospheric pressure by means of the solenoid valve which is actuated by a pulsating signal produced in the control signal generator. The pulse width of the pulsating signal is variable in accordance with a detected engine speed. The modified vacuum pressure is coupled to a chamber of a main valve of a conventional boost controlled deceleration device to control the amount of air-fuel mixture supplied to the intake manifold of the engine.

17 Claims, 4 Drawing Figures

APPARATUS FOR CONTROLLING THE ROTATIONAL SPEED OF AN I.C. ENGINE IN AN IDLING OPERATION

FIELD OF THE INVENTION

This invention relates generally to an apparatus for controlling the rotational speed of an internal combustion engine. More specifically, the present invention relates to such an apparatus in which the engine speed is maintained constant during an idling operation.

BACKGROUND OF THE INVENTION

It is advantageous to keep the rotational speed of of an internal combustion engine crank shaft at a desired value during an idling operation. The desired idling speed provides for the stable operation of the engine, eliminates unnecessary fuel consumption and reduces harmful components contained in the exhaust gases. During an idling operation, the amount of fuel, i.e. the fuel flow ratio, is determined by an idle adjust screw disposed at an idle port of a carburetor slow circuit. The idle adjust screw is so adjusted that a predetermined amount of fuel is fed into the intake manifold so that the engine rotates at a predetermined speed which is most desirable. However, the engine speed in a idling operation is apt to vary due to various reasons, such as variations of atmospheric pressure, ambient temperature, and engine temperature. For instance, the amount of fuel and/or air induced into the intake manifold of the engine are apt to vary due to deterioration of various members such as the throttle valve and the cylinders of the engine. Further, the ignition timing influences the engine speed.

In a conventional carburetor system, the idle adjust screw has to be adjusted each time the engine speed in an idling operation differs from the preset value. It is troublesome to manually adjust the screw which is disposed in the carburetor.

SUMMARY OF THE INVENTION

The present invention has been developed in order to overcome the inconvenience inherent to the conventional carburetor system. According to the present invention the engine speed is detected for controlling the flow rate of the air-fuel mixture by using a feedback control technique. For controlling the flow rate of the mixture, a mixture passage is provided in addition to the slow circuit. The additional mixture passage, however, is not a novel one and is a passage included in a boost controlled deceleration device such as disclosed in U.S. Pat. No. 4,008,696. In other words, the apparatus according to the present invention includes several elements and an electrical circuit which are applied to the conventional boost controlled deceleration device so that the apparatus functions not only as the conventional boost controlled deceleration device but also as an engine speed control system for the idling operation.

It is therefore, an object of the present invention to provide an apparatus for controlling the rotational speed of an internal combustion engine during an idling operation in which the engine speed is automatically controlled to maintain a predetermined speed.

Another object of the present invention is to provide such a system in which the apparatus is constructed by a few elements utilizing the conventional boost controlled deceleration device.

BRIEF DESCRIPTION OF THE DRAWINGS

These and other objects and features of the present invention will become more readily apparent from the following detailed description of the preferred embodiment taken in conjunction with the accompanying drawings in which.

DETAILED DESCRIPTION OF THE PREFERRED EMBODIMENT

Figure 1:
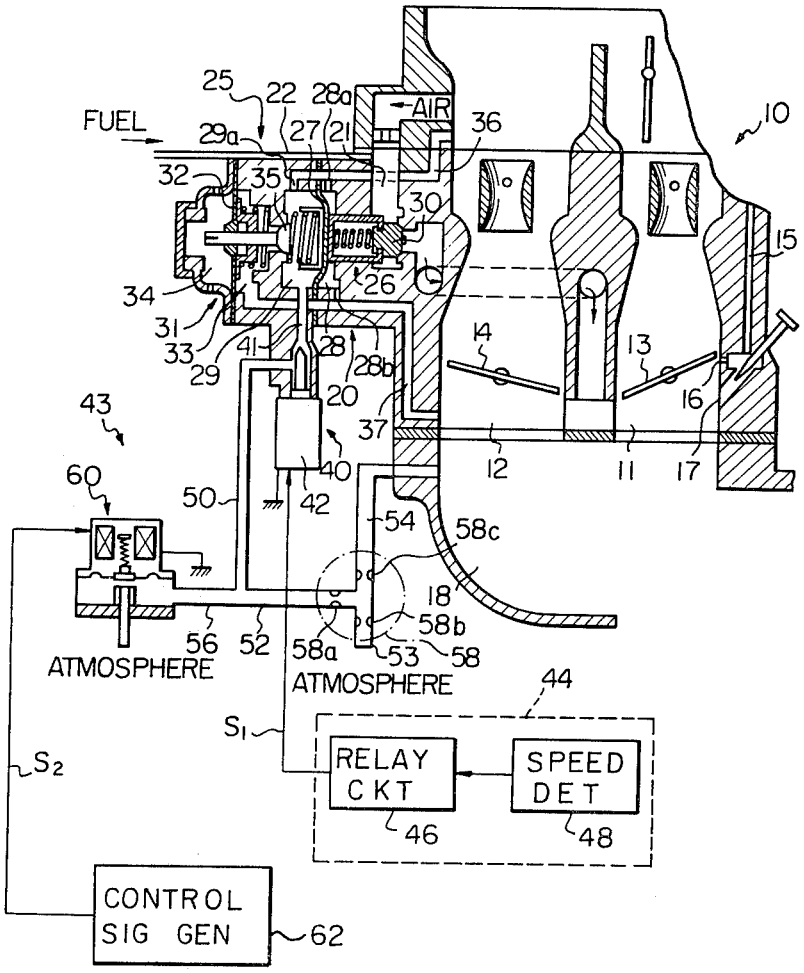
FIG. 1 is a schematic view of a preferred embodiment of the apparatus according to the present invention.

FIG. 1 is an illustration of a preferred embodiment of the apparatus for controlling internal combustion engine speed during an idling operation according to the present invention. The carburetor shown is denoted generally by a reference numeral 10. By way of illustration, carburetor 10 is of the dual barrel type and thus includes two (primary and secondary) induction passages 11 and 12. The induction passages 11 and 12 have respectively butterfly type throttle valves 13 and 14 which are responsive to the accelerator pedal (not shown). Whilst the embodiment using a dual barrel carburetor is illustrated, it will be readily understood that the improvement of the present invention is feasible for a carburetor of a single barrel type or of any other type. The induction passages 11 and 12 conventionally communicate with an engine intake manifold 18.

Each of the induction passages 11 and 12 is supplied with an air-fuel mixture through a main mixture supply passage (not shown). For light load or idling operation of the engine, a slow fuel supply passage 15 opens in the vicinity of the substantially closed throttle valve 13 through a slow port 16 and an idle port 17.

The carburetor comprises an additional mixture supply system indicated by 20 and an actuating means 40 which are included in a conventional boost controlled deceleration device and vacuum control means 43 operatively connected to the actuating means 40. The actuating means 40 is operatively connected with an electric control means 44, the arrangement and operation of which will be later described.

The additional mixture supply system 20 comprises a by-pass passage 21 which leads from upstream of the throttle valve 14, the outlet port thereof (no number) opening into the inlet of the intake manifold 18 downstream of the throttle valves 13 and 14 at a location between the two induction passages 11 and 12. A valve assembly 25 is disposed in the by-pass passage 21 to block passage 21 under conditions that will be described later. A fuel conduit 22 leading from a fuel tank (not shown) opens into the passage 21 upstream the valve assembly 25 so that an air-fuel mixture is formed before the mixture passes the valve assembly 25.

The valve assembly 25 includes a diaphragm-operated main valve 26 and a diaphragm-operated pilot valve 31. The main valve 26 has, as is conventional, a spring-loaded diaphragm 27 and two chambers 28 and 29 on opposite sides of the diaphragm. A valve head 30 is fixed to the diaphragm 27 by means of a slidable valve support (no numeral), to selectively block passage 21, valve head 30 bears against its seat (no numeral) formed on the inner surface of the passage 21. The chamber 28 communicates through a calibrated orifice 28*a* with an air passage 36 which in turn communicates upstream of the throttle valve 14 to permit air to flow into chamber 28. The chamber 28 has another calibrated orifice 28*b* the diameter of which is even smaller than that of the orifice 28*a*, the orifice 28*b* in turn communicating downstream of the throttle valve 14 through a vacuum passage 37. The orifice 28*b* serves to bleed off fuel which occasionally enters the chamber 28 from the passage 21 through a narrow clearance between the previously mentioned valve support and the housing wall enclosing it. The chamber 29 is communicable with a passage 50 included in the vacuum pressure control means 43 depending upon the operation of the actuating means 40 as will be described later. The chamber 29 also has a calibrated orifice 29*a* which communicates with the air passage 36.

The pilot valve 31 serves to prevent hunting of the main valve 26 and includes a diaphragm 32, two chambers 33 and 34 disposed on opposite sides of the diaphragm 32, one chamber 34 being vented to the atmosphere through unnumbered orifices. The chamber 33 communicates downstream of the throttle valve 14 through the passage 37 for sensing a vacuum at the inlet of intake manifold 18. Chamber 33 is communicable with the chamber 29 of the main valve 26 via pilot valve 31, having a head 35 which is fixed to the diaphragm 32 which is movable to cut off communication between the chambers 33 and 29.

The actuating means 40 referred to previously comprises a solenoid valve 42 which is disposed in an air bleed 41 opening into the chamber 29, the latter being communicable with the passage 50 upon opening of the solenoid valve 42.

The vacuum control means 43 includes of passages 50, 52, 53, 54 and 56, a second solenoid valve 60 and a control signal generator 62. The passage 50 is in fluid flow relation with passages 52 and 56. The passage 56 is communicable with the atmospheric air via the second solenoid valve 60 interposed therein. The passage 52 is connected to a constant pressure valve means 58. The constant pressure valve means 58 includes a passage 54 communicating with the intake manifold 18, and another passage 53 communicating with the atmospheric air. Passages 52, 53 and 54 have a common junction and respectively have internal orifices 58*a*, 58*b* and 58*c* in the vicinity of the junction thereof. Constant pressure valve 58 maintains the pressure in the passage 52 constant by supplying the vacuum in the intake manifold 18 and the atmospheric air via the orifices 58*a*, 58*b* and 58*c* to the passage 52.

The second solenoid valve 60 is responsive to an electrical signal $S_2$ applied thereto from the control signal generator 62. It is to be noted that the arrangement of the additional mixture supply system 20 per se is known as a boost controlled deceleration device for additionally supplying an air-fuel mixture to the intake manifold 18 in response to the vacuum produced in the intake manifold 18. In the conventional boost controlled deceleration device, the first solenoid valve 42 is actuated when the vehicle speed is below a predetermined value such as 15 Km/h, to supply chamber 29 of the main valve 26 with atmospheric air. However, in the arrangement shown in FIG. 1, the passage 41 communicated with the chamber 29 is communicable with the atmospheric air via the passage 50 only when both of the first solenoid valve 42 and the second solenoid valve 60 are actuated.

It will be understood, therefore, from the foregoing, that the novel feature of the present invention resides in the arrangement of the passages 50, 52, 53, 54, 56 and the second solenoid valve 60 which is operated in accordance with the signal $S_2$ produced by the control signal generator 62.

The operation of the apparatus will be described hereinafter. Prior to describing the control of the engine speed during an idling operation, consideration is given to functioning to the conventional boost controlled deceleration device, i.e. the additional mixture supply system 20, since it will be helpful to understand the function of the engine speed control.

The chamber 33 of the pilot valve 31 is supplied with the vacuum, via the passage 37, in the intake manifold 18. In response to chamber 33 receiving the vacuum pressure the diaphragm 32 tends to move toward right, in FIG. 1, against the force of a spring connected to the diaphragm 32 in accordance with the magnitude of the vacuum prevailing in the chamber 33. When the vacuum exceeds a predetermined value, the valve head 35 fixedly connected to the diaphragm 32 moves right, from its seated position to its unseated position, opening the valve 31 to so chamber 33 communicates with chamber 29 of the main valve 26. Since the solenoid valve 42 is normally closed unless the vehicle speed is below a predetermined value, the pressure in the chamber 29 is substantially equal to the pressure in the chamber 33. The diaphragm 27 of the main valve 26 is thus biased to the left against the force of the spring connected to the diaphragm 27, since the pressure in the other chamber 28 is of the atmospheric pressure. The valve head 30 of the main valve 26 thus moves to its unseated position from the seated position opening the by-pass mixture passage 21. With this arrangement, the air-fuel mixture produced in the by-pass passage 21 is supplied to the intake manifold 18, in which the amount of the mixture is controlled in accordance with the magnitude of the vacuum in the intake manifold 18 since the stroke of the valve head 30 is determined by the magnitude of the vacuum.

If the vacuum in the intake manifold 18 is lower than the above mentioned predetermined value, however, the pilot valve 31 does not open and thus the valve head 35 remains at its seated position so that the vacuum in the intake manifold 18 does not enter the chamber 29 of the main valve 26. Upon balanced pressure which is of the atmospheric pressure at both chambers 29 and 28 at both sides of the diaphragm 27 of the main valve 26, the diahragm 27 stays at its normal position and thus the valve head 30 blocks the by-pass passage 21. It will be understood that no additional air-fuel mixture is induced into the intake manifold 18 via the by-pass passage 21 upon the above mentioned condition.

The above mentioned operation has been described under an assumption that the first solenod valve 42 is not actuated to block the passage 41 communicating with the chamber 29. The first solenoid valve 42 is arranged to block the passage 41 upon presence of an electrical signal $S_1$ indicating that the vehicle speed is below a predetermined value, such as 15 Km as mentioned hereinbefore. The function of the first solenoid valve 42 is to disable the boost controlled deceleration device to prevent unnecessary fuel consumption and hunting phenomena of the engine during a low speed operation of the engie when the additional mixture supply system 20 is utilized only for the conventional boost controlled deceleration device. For achieving the above mentioned function, the first solenoid valve 42 is actuated when the vehicle speed is below a predetermined value and the second solenoid valve 60 is actuated to open the passage 56 to the atmosphere when the vehicle speed is below the predetermined speed and is over zero. The control signal generator 62 is so arranged to produce an electrical signal $S_2$ to control the second solenoid valve 60, opening the passage 56 continuously when the vehicle speed is between zero and the predetermined value. The cotrol signal generator further produces the electrical signal $S_2$ in the form of a train of pulses when the engine is in an idling operation. The detailed arrangement and the operation of the control signal generator 62 are described infra in connection with FIG. 2.

The electronic control means 44, which is conventional, consists of a vehicle speed detector 48 and a relay circuit 46 responsive to the vehicle speed detector 48. The detailed arrangement of the vehicle speed detector 48 will be described together with other vehicle speed detector included in the control signal generator 60 hereinlater in connection with FIG. 4. The vehicle speed detector 48 is arranged to produce an output signal indicating that the vehicle speed is below the predetermined value. The output of the vehicle speed detector 48 is connected to an input of the relay circuit 46 so that the relay circuit 46 produces an output signal $S_1$ with which the first solenoid valve 42 is energized in response to the output signal of the vehicle speed detector 48. As well known, the relay circuit 46 may be replaced with a semiconductor switching element, such as a power transistor.

Under an idling operation of the engine, the magnitude of the vacuum in the intake manifold 18 is relatively low so diaphragm 32 is operated against the force of the spring connected thereto and thus the valve head 35 stays at its seated position. At this time the first solenoid valve 42 is actuated to open the passage 41, while the second solenoid valve 60 assumes a segmented ON-OFF, i.e. open-close, operation in response to a pulsating signal produced in the control signal generator 62. Meanwhile, the vacuum in the intake manifold 18 is induced into the passage 54 of the constant pressure valve 58. The vacuum in the passage 54 is supplied via the orifice 58*c* to the junction portion of the constant pressure valve 58. Since the atmospheric air is induced into the junction portion via the orifice 58*b*, disposed in the passage 53, the vacuum induced from the intake manifold 18 is diluted to a given extent and is induced via the orifice 58*a* into the passage 52. With this arrangement, the pressure prevailing in the passage 52 is maintained constant. The passage 52 is communicable with the atmospheric air via the passage 56 and the second solenoid valve 60 so that the constant vacuum in the passage 52 is further diluted by the atmospheric air induced via the passage 56. It will be understood that the rate of the dilution of the vacuum in the passage 52 is determined by the ON-OFF ratio of the second solenoid valve 60. A junction between the passages 52 and 56 is in fluid flow relation with passage 41 connected via the passage 50 when the first solenoid valve 42 is actuated.

Since the vacuum prevailing in the passage 50 is induced into the chamber 29, the diaphragm 27 is actuated in accordance with the magnitude of the in passage 50. Diaphragm 27 is so actuated although valve head 35 is closed to prevent a vacuum from being induced via the passage 37 and the chamber 33 of the pilot valve 31. In respose to the vacuum prevailing in the chamber 29, the valve head 30 of the main valve 26 is actuated to open the by-pass passage 21 in the same manner as in the function of the boost controlled deceleration device which was discussed before.

Summarizing the function of the above mentioned passages 50, 52, 53, 54, 56 and the second solenoid valve 60, the vacuum pressure obtained in the passage 52 is modified by the atmospheric pressure in accordance with the ON-OFF ratio of the second solenoid valve 60. Then the modified, i.e. diluted, vacuum in passage 50 induced into the chamber 29 to actuate the diaphragm 27 and to control the amount of air-fuel mixture supplied via the by-pass passage 21 into the intake manifold 18.

In the preferred embodiment, the passage 52 is connected via the orifices 58*a*, and 58*c* to the passage 54 for communicating with the intake manifold 18, and via the orifices 58*a* and 58*b* to the passage 53 for communicating with the atmospheric air as described hereinbefore. Since the function of the vacuum pressure valve 58 is to provide a constant avacuum pressure, a suitable vacuum pump (not shown) may be employed in place of the constant pressure valve 58 including the passages 54 and 53. In this case, the vacuum pump which is arranged to produce a predetermined vacuum is connected in fluid flow relation to the passage 52 for maintaining the pressure in the passage 52 constant.

It will be understood that an additional air-fuel mixture is supplied via the by-pass mixture passage 21 to the intake manifold 18 to control the engine speed during an idling operation. This means that in an idling operation an air-fuel mixture is supplied via not only the slow port 16 and the idle port 17 but also via the by-pass passage 21. Since an additional air-fuel mixture is fed via the by-pass passage 21, the idle adjust screw (no numeral) disposed in the slow fuel supply passage 15 is so adjusted that a predetermined amount of air-fuel mixture which is less than that in a conventional type is supplied via the idle port 17. In other words, the sum of air-fuel mixtures respectively supplied via the idle port 17 and the by-pass passage 21 is designed to correspond to the amount of air-fuel mixture supplied via the idle port 17 in a conventional carburetor system. However, if the amount of air-fuel mixture supplied via the by-pass passage 21 is designed to correspond with that supplied via the idle port 17 in a conventional carburetor system, the slow fuel supply passage 15 may be omitted.

Figure 2:
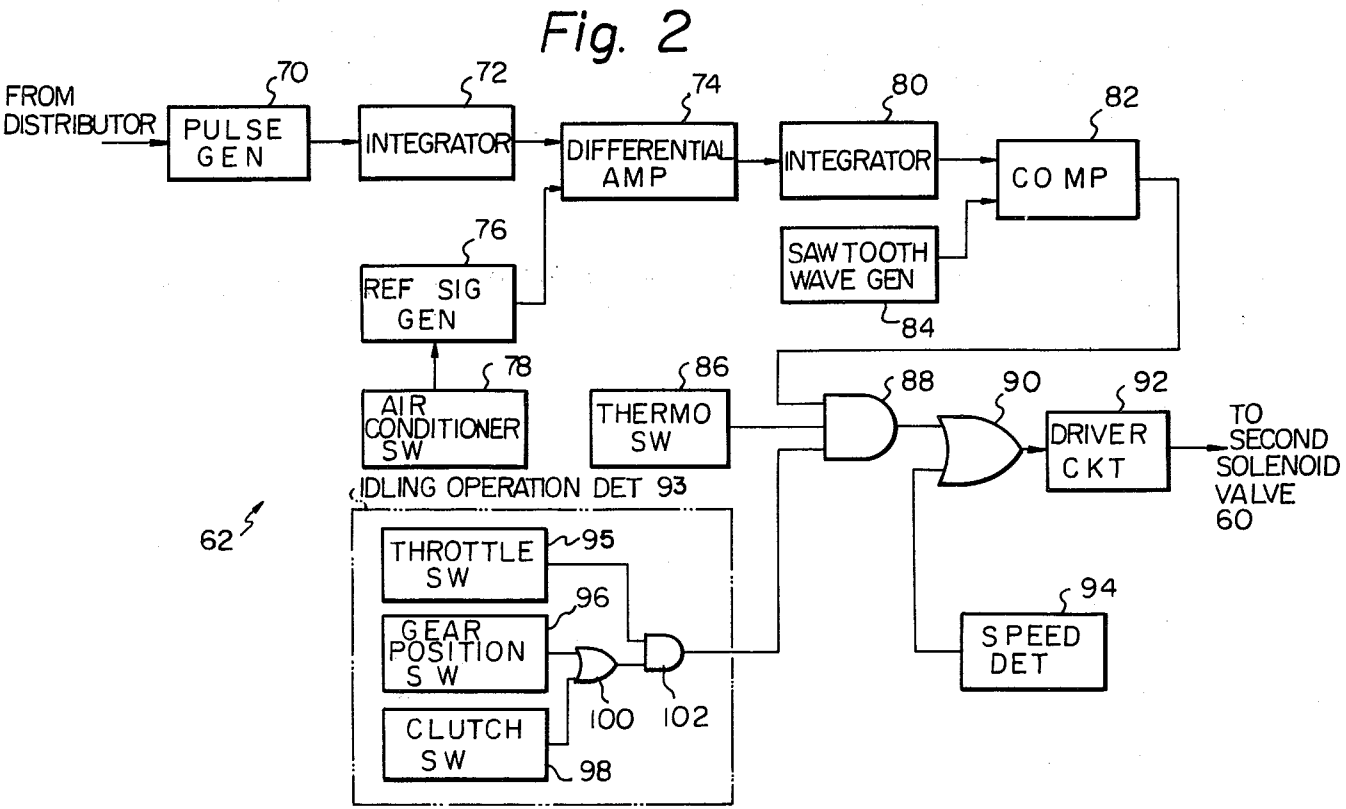
FIG. 2 is a block diagram of the detailed circuit of the control signal generator shown in FIG. 1.

Reference is now made to FIG. 2 a block diagram of the detailed circuit of the control signal generator 62 shown in FIG. 1. The control signal generator 62 includes a pulse generator 70, an integrator 72, a differential amplifier 74, a reference signal generator 76, an air conditioner switch 78, a second integrator 80, a saw tooth wave signal generator 84, a comparator 82, an idling operation detector 92, an AND gate 88, an OR gate 90, a vehicle speed detector 94, and a driver circuit 92. The idling operation detector 92 includes a throttle switch 94, a gear position switch 96, a clutch switch 98, an OR gate 100, and an AND gate 102.

The pulse generator 70 is responsive to ignition pulses derived from the distributor (not shown) of the engine to produce a pulse train signal, the number of pulses of which per unit time is in proportion to the rotational speed of the crank shaft of the internal combustion engine. The output of the pulse generator 70 is connected to an input of the integrator 72 and thus the integrator 72 produces an analog output signal the magnitude of which is indicative of the engine speed. The analog signal produced in the integrator 72 is fed to an input of the differential amplifier 74 housing another input connected to be responsive to a reference output signal of the reference signal generator 76. The reference signal generator 76 is constructed as a suitable voltage divider to obtain a predetermined voltage as the reference signal. The air conditioner switch 78 is responsive to the operation of an air conditioner, if mounted on the vehicle, and is arranged to produce an output signal when the compressor of the air conditioner is turned on. Upon presence of the output signal of the air conditioner switch 78, the reference signal generator 76 is arranged to produce a second predetermined voltage which is higher than the first predetermined voltage produced when the output signal of the air conditioner switch 78 is not applied thereto. Although the voltage of the reference signal is described as predetermined at first or second voltages, the voltage of the reference signal may be variable at will if desired. A detailed circuit and the operation of the reference signal generator 76 are described infra in connection with FIG. 3.

The differential amplifier 74 produces an output signal, the magnitude of which is proportional of the difference in voltage, between the analog output signal of the integrator 72 and the reference signal. The output of the differential amplifier 74 is fed to the second integrator 80 so that the output signal of the differential amplifier 74 is integrated. The output signal of the second integrator 80 is supplied to an input of the comparator 82, housing an input which is fed with a saw tooth wave signal, which is usually called a dither signal, produced in a saw tooth wave signal generator 84. The peak to peak voltage and the frequency of the saw tooth wave are predetermined and are constant. The comparator 82 produces a bi-level or logic output signal by comparing the magnitude of the output signal of the second integrator 80 with the magnitude of the saw tooth wave signal. Namely, the comparator 82 produces a pulse signal having a variable pulse width in accordance with the magnitude of the signal from the second integrator 80. This means that the comparator 82 functions as a pulse width modulation (PWM) circuit to produce a PWM signal. The PWM signal produced by the comparator 82 is fed to an input of the AND gate 88. Since the output of the AND gate 88 is connected via the OR gate 90 to an input of the driver circuit 92 which produces a valve energization signal $S_2$ in response to an input signal, the pulse modulation signal from the comparator 82 is supplied to the driver circuit 92 if the other two inputs of the AND gate 88 are respectively supplied with signals.

One input of the OR gate 90 is connected to an output of the vehicle speed detector 94 to receive a signal indicating that the vehicle speed is between, but not equal to zero and a predetermine value, e.g., 15 Km/h in this embodiment. The output signal of the vehicle speed detector 94 is supplied via the OR gate 90 to the drive circuit 92 and thus the driver circuit 92 produces the valve energization signal $S_2$ not in the form of pulses but in the form of a direct current. The driver circuit 92 may be a suitable relay or a semiconductor switching element such as a power transistor. It will be understood that the second solenoid valve 60 shown in FIG. 1 is actuated by the direct current produced by the driver circuit when the vehicle speed is between zero and fifteen Km/h. It is to be noted that the vehicle speed detector 94 does not produce the output signal when the vehicle speed is zero, i.e. when the vehicle is stationary.

The thermo switch 86, housing output connected to an input of the AND gate 88, is responsive to the engine temperature and produces an output signal of a logic level when the engine temperature is over a predetermined value. The thermo switch 86 is provided to supply the PWM signal produced in the comparator 82 to the driver circuit 92 via the OR gate 90 only when the engine temperature is above a predetermined value in which the engine is able to operate in a stable manner. In other words, the second solenoid valve 60 is maintained closed continuously when the engine temperature is below the predetermined value even though the vehicle speed is zero. The thermo switch 86 is of any known type such as a comparator connected to a voltage divider including a thermister (sensor) disposed in the engine casing to be exposed to the engine coolant.

The idling operation detector 93 is arranged to produce an output signal of a logic level when the engine is in the idling operation. The throttle switch 95 is operatively connected to the shaft of the throttle valve 13 disposed in the primary intake passage 11. The throttle valve 13 is directly operated by the accelerator pedal of the vehicle, while the other throttle valve 14 of the secondary intake passage 12 opens when the opening degree of the throttle valve 13 is over a predetermined value. The throttle switch 95 is arranged to produce an output signal of a logic level when the throttle valve 13 is fully closed to supply the output signal to an input of the AND gate 102.

The gear position switch 96 is operatively connected to the transmission or the gear shift lever of the same to detect the neutral position of the transmission. The gear position switch 96 is arranged to produce an output signal of a logic level when the transmission of the vehicle is in the neutral position to supply the logic signal to an input of the OR gate 100, having an output connected to the other input of the AND gate 102.

The clutch switch 98 is operatively connected to the clutch or the clutch pedal of the vehicle to produce an output signal of a logic level when the clutch is disengaged to supply the logic signal to the other input of the OR gate 100. The AND gate 102 is, therefore, responsive to the output signal of the throttle switch 94 and the output signal of the OR gate 100 to produce an output logic signal upon presence of the output signal of the throttle switch 94 and at least one of the output signals from the gear position switch 96 and the clutch switch 98. The above mentioned three signals, respectively indicative of the fully closed state of the throttle valve 13, the neutral position of the transmission, and the disengaged state of the clutch, are used for estimating an idling operation of the engine. Therefore, one of the gear position switch 96 and the clutch switch 98 may be omitted if desired and other parameters with which the idling operation can be estimated may be used.

From the foregoing, it will be understood that the AND gate 88 produces a PWM signal when all of the inputs thereof are fed with logic signals. In other words, the PWM signal derived from the comparator 82 is coupled through AND gate 88 when the output signals of the thermo switch 86 and the AND gate 102 are fed to the AND gate 88. With this arrangement the PWM signal is then fed to the driver circuit 92 via the OR gate 90 so that the driver circuit 92 produces the aforementioned pulse signal $S_2$ with which the second solenoid valve 60 is periodically energized. It is to be noted that the pulse width of the signal $S_2$ is the function of the engine speed and is arranged to become wider and wider as the engine speed tends to be higher than a predetermined speed. Consequently, the period of time for which the second solenoid valve 60 is actuated to open the passage 56 increases so that the vacuum pressure in the passage 50 reduces, approaching the atmospheric pressure. Since the pressure in the chamber 29 is substantially the same as that in the passage 50, the diaphragm 27 tends to return to the normal position and thus the cross sectional area of the by-pass passage defined by the position of the valve head 30 is reduced. The amount of air-fuel mixture fed through the by-pass passage 21 is decreased accordingly. When the engine speed during the idling operation is below the predetermined value, the amount of air-fuel mixture fed through the by-pass passage 21 is increased in an opposite manner.

With the above mentioned operations, the amount of air-fuel mixture is controlled to maintain the predetermined engine speed. It can be said that the apparatus according to the present invention performs a feedback control of the engine speed for an idling operation with a closed loop circuit.

In the circuit diagram shown in FIG. 2, logic gates are used as described. However, the logic gates 100, 102, 88 and 90 may be replaced by a suitable relay circuits if desired.

Figure 3:
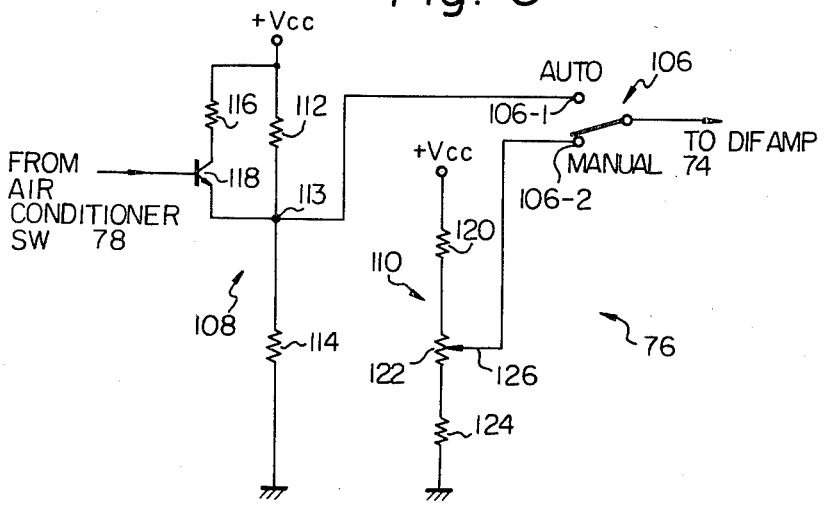
FIG. 3 is a detailed circuit diagram of the reference signal generator shown in FIG. 2.

Reference is now made to FIG. 3, a detailed circuit diagram of the reference signal generator 76 shown in FIG. 2. The reference signal generator 76 includes a switch 106, first and second voltage dividers 108 and 110 respectively connected to first and second terminals 106-1 and 106-2 of the switch 106, and a transistor 118 connected to the first voltage divider 108. The switch 106 is a manual toggle switch having a movable contact connected to an input of the differential amplifier 74 shown in FIG. 2. The movable contact is arranged to selectively contact first and second contacts 106-1 and 106-2 respectively. As indicated in FIG. 3, when the vehicle driver wishes to set the engine speed in an idling operation at a predetermined value, he turns the movable contact to the AUTO position so that the movable contact is in contact with the first contact 106-1. On the other hand if the vehicle drive intends to adjust the engine speed manually, he turns the movable contact to the MANUAL position so that the movable contact is in contact with the second contact 106-2.

The first voltage divider 108, including series resistors 112 and 114, is interposed between ground and a terminal to which a positive predetermined voltage +Vcc is supplied. A junction 113 for resistors 112 and 114 is coupled to the first contact 106-1 of the switch 106. The positive voltage terminal is further connected via a resistor 116 and a collector-emitter path of a transistor 118 to the junction 113. A base of the transistor 118 is connected to the output of the air conditioner switch 78 shown in FIG. 2 to receive the output signal thereof.

When no signal is supplied from the air conditioner switch 78 to the base of the transistor 118, the transistor 118 is nonconductive and thus the voltage at the junction 113 is simply determined by the dividing ratio defined by the resistances of the resistors 112 and 114. This voltage at the junction obtained by dividing the predetermined voltage +Vcc by the resistors 122 and 114 is referred to as a first predetermined voltage. When the output signal of the air conditioner switch 78 is fed to the base of the transistor 118, the transistor 118 becomes conductive and thus the resistor 116 is electrically connected in parallel with the resistor 112 so that a voltage which is higher than the first predetermined voltage is obtained at the junction 113. This higher voltage is referred to as a second predetermined voltage. The voltage at the junction 113 is fed via the manual switch 106 to the differential amplifier 74 when the manual toggle switch 106 assumes the AUTO position. With this arrangement, the voltage of the reference signal assumes first and second predetermined voltages in accordance with the ON and OFF states of the compressor of the air conditioner. Since the higher voltage of the reference signal source corresponds to a higher engine speed, the engine speed during an idling operation is increased when the air conditioner is turned on.

The second voltage divider 110 included in the reference signal generator 76, including a resistor 120, a variable resistor 122, and a resistor 124 connected in series, is interposed between a positive voltage power supply terminal +Vcc and ground. A movable contact 126 of the variable resistor 122 is coupled to the second contact 106-2 of the toggle switch 106. The movable contact 126 of the variable resistor 122 is arranged to be operated by the vehicle driver so as to obtain a suitable voltage which corresponds to a desired engine speed. For convenience of the adjustment of the voltage the variable resistor is disposed at the instrument panel, preferably in the vicinity of the tachometer which indicates the engine speed.

From the foregoing, it will be apparant that one of the automatically predetermined voltage or the manually adjusted voltage is selectively supplied via the manual switch 106 to the differential amplifier 74 as the reference signal.

Figure 4:
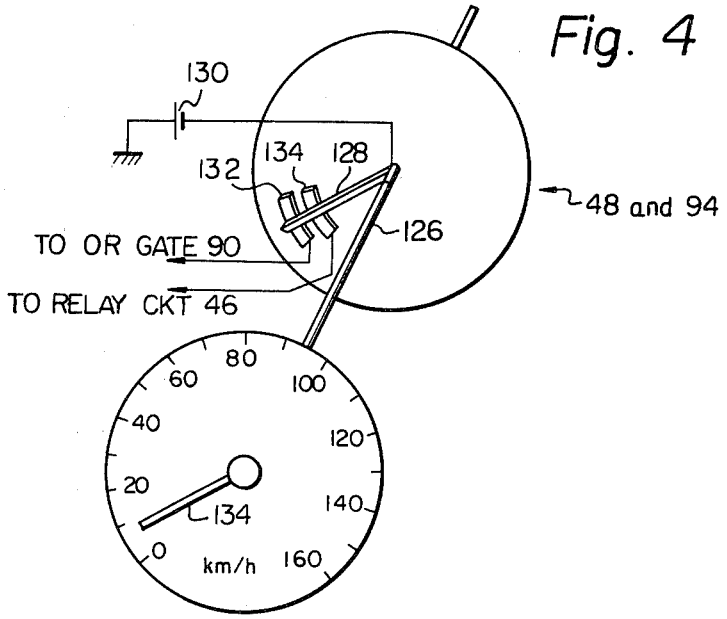
FIG. 4 is an illustration of an arrangement of the vehicle speed detectors shown in FIG. 1 and FIG. 2.

Reference is now made to FIG. 4, an illustration of an arrangement of the vehicle speed detectors 48 and 94 shown in FIG. 1 and FIG. 2. The vehicle speed detectors 48 and 94 are incorporated in the speedometer of the vehicle and have a movable contact 128 and first and second stationary contacts 132 and 134 disposed on a suitable member (no numeral). The movable contact 128 is fixedly connected to the shaft 126 of the speedometer, so they rotate together and with the hand 134 of the speedometer. The movable contact 128 is electrically connected via the shaft 126 to the positive terminal of a suitable power supply, such as a battery 130, while stationary contacts 132 and 134 are respectively connected to the input of the OR gate 90 shown in FIG. 2 and to the input of the relay circuit 46 shown in FIG. 1. The vehicle speed detector 48 is arranged to produce an output signal when the vehicle speed is below the aforementioned predetermined speed, while the other vehicle speed detector 94 is arranged to produce an output signal when the vehicle speed is over zero and is below the predetermined speed.

Although the arrangement of the vehicle speed detectors 48 and 94 is of the mechanical type, the vehicle speed detectors 48 and 94 may be constructed by electrical circuits such as a comparator responsive to an analog signal indicative of the vehicle speed.

While a preferred embodiment of the present invention has been described using specific terms, such description is for illustrative purposes only, and is to be understood that changes and variations will be made without departing from the spirit and scope of the invention defined by the following claims.

What is claimed is:

1. Apparatus for controlling the rotational speed of an internal combustion engine of a vehicle in an idling operation, said engine being equipped with a carburetor having a by-pass air-fuel mixture supply passageway communicating between a source of air-fuel mixture supply and the intake manifold of said engine for supplying the intake manifold with an additional air-fuel mixture, a valve assembly disposed in said passageway to control the cross sectional area of said passageway, and an expansible chamber operatively connected to said valve assembly, wherein the improvement comprises:

(a) first passage selectively in fluid flow relation between said expansible chamber and a source of vacuum pressure of a predetermined value;

(b) a second passage connected in fluid flow relation between said first passage and atmosphere;

(c) a solenoid operated valve means interposed in said second passage for selectively shutting said second passage in response to an electrical signal fed thereto;

(d) a control signal generator for producing said electrical signal in accordance with the engine speed only when the engine is in an idling operation;

wherein said source of vacuum pressure comprises a third passage communicating with said intake manifold and a fourth passage communicating with the atmospheric air, and a fifth passage connected in fluid flow relation with said first passage, said third, fourth and fifth passages being joined at a junction, each of said third, fourth and fifth passages having an orifice in the vicinity of said junction.

2. Apparatus for controlling the rotational speed of an internal combustion engine of a vehicle in an idling operation, said engine being equipped with a carburetor having a by-pass air-fuel mixture supply passageway communicating between a source of air-fuel mixture supply and the intake manifold of said engine for supplying the intake manifold with an additional air-fuel mixture, a valve assembly disposed in said passageway to control the cross sectional area of said passageway, and an expansible chamber operatively connected to said valve assembly, wherein the improvement comprises:

(a) first passage selectively in fluid flow relation between said expansible chamber and a source of vacuum pressure of a predetermined value;

(b) a second passage connected in fluid flow relation between said first passage and atmosphere;

(c) a solenoid operated valve means interposed in said second passage for selectively shutting said second passage in response to an electrical signal fed thereto;

(d) a control signal generator for producing said electrical signal in accordance with the engine speed only when the engine is in an idling operation;

wherein said first passage is communicable with said expansible chamber via a solenoid valve which controls the communication therebetween in accordance with vehicle speed.

3. Apparatus for controlling the rotational speed of an internal combustion engine of a vehicle in an idling operation, said engine being equipped with a carburetor having a by-pass air-fuel mixture supply passageway communicating between a source of air-fuel mixture supply and the intake manifold of said engine for supplying the intake manifold with an additional air-fuel mixture, a valve assembly disposed in said passageway to control the cross sectional area of said passageway, and an expansible chamber operatively connected to said valve assembly, wherein the improvement comprises:

(a) first passage selectively in fluid flow relation between said expansible chamber and a source of vacuum pressure of a predetermined value;

(b) a second passage connected in fluid flow relation between said first passage and atmosphere;

(c) a solenoid operated valve means interposed in said second passage for selectively shutting said second passage in response to an electrical signal fed thereto;

(d) a control signal generator for producing said electrical signal in accordance with the engine speed only when the engine is in an idling operation;

wheresaid said control signal generator comprises:

(a) first means for producing a signal indicative of engine speed;

(b) second means for producing a reference signal indicative of a preset engine speed;

(c) third means for producing a pulse width modulation signal in accordance with the signals obtained by said first and second means;

(d) fourth means for producing a signal indicative of an idling operation of said engine;

(e) fifth means for transmitting said pulse width modulation signal upon presence of the signal from said fourth means, and (f) sixth means for producing a valve actuating signal in response to the output signal of said fifth means.

4. Apparatus as claimed in claim 3, wherein said second means is responsive to a signal indicative of the increase of the load of said engine for changing the magnitude of said reference signal.

5. Apparatus as claimed in claim 4, wherein said second means further comprises means for manually adjusting the magnitude of said reference signal.

6. Apparatus as claimed in claim 5, wherein said second means comprises:

(a) a first voltage divider for producing a first predetermined voltage;

(b) a switching element for electrically connecting a resistor to another resistor included in said first voltage divider in response to a signal indicating that the compressor of an air conditioner driven by the engine is turned on, for producing a second predetermined voltage;

(c) a second voltage divider including a variable resistor having a movable contact which is manually adjustable for producing a variable voltage; and (d) a manual switch for selectively transmitting one of the voltages obtained by said first and second voltage dividers.

7. Apparatus as claimed in claim 3, wherein said fourth means comprises means for producing a first signal indicative of the fully closed position of the throttle valve of said engine, and means for producing a second signal indicative of the neutral position of the transmission of said vehicle, said signal indicative of the idling operation being produced upon presence of both of said first and second signals.

8. Apparatus as claimed in claim 3, wherein said fourth means comprises means for producing a first signal indicative of the fully closed position of the throttle valve of said engine, and means for producing a third signal indicative of the clutch disengagement of the clutch of said vehicle, said signal indicative of the idling operation being produced upon presence of both of said first and third signals.

9. Apparatus as claimed in claim 3, wherein said fourth means comprises means for producing a first signal indicative of the fully closed position of the throttle valve of said engine, means for producing a second signal indicative of the neutral position of the transmission of said vehicle, and means for producing a third signal indicative of the clutch-off position of the clutch of said vehicle, said signal indicative of the idling operation being produced upon presence of both of said first signal and at least one of said second and third signals.

10. Apparatus as claimed in claim 3, wherein said control signal generator further comprises means for producing a fourth signal indicating that the engine temperature is over a predetermined value, said pulse width modulation signal being transmitted upon presence of said fourth signal.

11. Apparatus as claimed in claim 3, wherein said control signal generator further comprises means for producing a fifth signal indicating that the vehicle speed is between zero and a predetermined value, said sixth means producing a direct current for continuously actuating said solenoid valve upon presence of said fifth signal.

12. Apparatus for controlling the rotational speed of an internal combustion engine of a vehicle in an idling operation, said engine being equipped with a carburetor having a by-pass air-fuel mixture supply passageway communicating between a source of air-fuel mixture supply and the intake manifold of said engine for supplying the intake manifold with an additional air-fuel mixture, a valve assembly disposed in said passageway to control the cross sectional area of said passageway, and an expansible chamber operatively connected to said valve assembly, wherein the improvement comprises: means for controlling the valve assembly to increase and decrease, by variable amounts between limits, the cross sectional area of the by-pass passageway for the mixture during idling by controlling the pressure in the chamber by variable amounts between limits as a function of engine idle speed, wherein said controlling means includes a constant pressure source, means for varying the average pressure of the source by variable amounts between limits as a function of idling engine speed, whereby a modified pressure source is derived, and a passage selectively in fluid flow relation between the modified pressure source and the chamber for selectively coupling the pressure of the modified source to the chamber so that the position of the valve assembly in the by-pass passageway during idling is a function of said average pressure.

13. The apparatus of claim 12 wherein the means for varying includes means for combining fluid from the constant pressure source with fluid from a variable duty cycle source having a duty cycle that varies between limits as a function of idling speed.

14. The apparatus of claim 13 wherein the variable duty cycle source includes a valve having a port for selectively coupling atmospheric air to the constant pressure source, said valve including means for selectively preventing coupling of atmospheric air from the port to the constant pressure source.

15. The apparatus of claim 12 or 13 or 14 further including means for blocking the fluid flow relation between the passage and the chamber in response to the engine speed being above a predetermined value.

16. The apparatus of claim 12 or 13 or 14 wherein the constant pressure source includes a first conduit having an inlet in the intake manifold, a second conduit having an inlet responsive to atmospheric pressure, and a third conduit having a common connection to the first and second conduits, said first, second and third conduits including flow restricting orifices adjacent the common connection so the constant pressure is established as a predetermined vacuum in the third conduit, said third conduit being in fluid flow relation with the passage.

17. The apparatus of claim 13 wherein the variable duty cycle source includes a valve having an inlet port for selectively coupling atmospheric air to an outlet port thereof, said valve including means for selectively preventing coupling of of atmospheric air from the inlet port to the outlet port, the constant pressure source including a first conduit having an inlet in the intake manifold, a second conduit having an inlet responsive to atmospheric pressure, and a third conduit having a common connection to the first and second conduits, said first, second and third conduits including flow restricting orifices adjacent the common connection so the constant pressure is established as a predetermined vacuum in the third conduit, said third conduit being in fluid flow relation with the outlet port, the fluid flows from the outlet port and the third conduit being combined in the passage.

* * * * *